US006354661B1

(12) United States Patent
Moss

(10) Patent No.: US 6,354,661 B1
(45) Date of Patent: Mar. 12, 2002

(54) CHAIR COCOON

(76) Inventor: Anne Masako Moss, 53 Leonard St., New York, NY (US) 10013

( * ) Notice: Subject to any disclaimer, the term of this patent is extended or adjusted under 35 U.S.C. 154(b) by 0 days.

(21) Appl. No.: 09/477,427

(22) Filed: Jan. 4, 2000

Related U.S. Application Data

(60) Provisional application No. 60/114,937, filed on Jan. 6, 1999.

(51) Int. Cl.[7] ..... A47C 31/11

(52) U.S. Cl. ..... 297/229; 297/224; 297/228.11; 297/228.13

(58) Field of Search ..... 297/229, 224, 297/225, 228.1, 228.11, 228.12, 118.13; 248/345.1

(56) References Cited

U.S. PATENT DOCUMENTS

| | | | | | |
|---|---|---|---|---|---|
| 517,306 | A | * | 3/1894 | Seher | 297/228.13 X |
| 641,988 | A | * | 1/1900 | McIntyre | 297/229 X |
| 1,789,245 | A | * | 1/1931 | Mcintyre | 297/229 X |
| 1,820,104 | A | * | 8/1931 | Whaley | 297/229 X |
| 1,825,909 | A | * | 10/1931 | Levi | 297/229 X |
| D104,187 | S | * | 4/1937 | Fry | 297/224 X |
| 2,100,868 | A | * | 11/1937 | Oppenheimer, Jr. | 297/224 |
| 2,212,485 | A | * | 8/1940 | Krasnov | 297/224 |
| 2,286,171 | A | * | 6/1942 | Krasnov et al. | 297/224 |
| 2,363,271 | A | * | 11/1944 | Sugarman | 297/224 X |
| 2,367,450 | A | * | 1/1945 | Trubitz | 297/224 |
| 2,537,100 | A | * | 1/1951 | Smith | 297/229 |
| 2,667,211 | A | * | 1/1954 | Krasnov et al. | 297/224 |
| RE24,221 | E | * | 9/1956 | Waranch | 297/224 X |
| 2,848,039 | A | * | 8/1958 | Lenz | 297/224 |
| 3,220,767 | A | * | 11/1965 | Hendrickson | 297/228.13 X |
| 4,225,179 | A | * | 9/1980 | Oltrona Visconti | 297/229 X |
| 4,669,779 | A | * | 6/1987 | Kaganas et al. | 297/229 |
| 4,693,511 | A | * | 9/1987 | Seltzer et al. | 297/224 X |
| D307,995 | S | | 5/1990 | Kelldorf | |
| 4,946,221 | A | * | 8/1990 | Livingston | 297/224 X |
| 4,958,886 | A | * | 9/1990 | Barattini et al. | 297/229 |
| 5,005,901 | A | * | 4/1991 | Hinde | 297/229 |
| 5,150,945 | A | * | 9/1992 | Aupperlee et al. | 297/229 X |
| 5,150,947 | A | * | 9/1992 | Croshaw | 297/229 |
| 5,320,407 | A | * | 6/1994 | Tell | 297/229 X |
| 5,549,355 | A | * | 8/1996 | Illulian | 297/229 X |
| 5,845,967 | A | * | 12/1998 | Kane et al. | 297/229 X |
| 6,036,261 | A | * | 3/2000 | Woods et al. | 297/224 X |
| 6,079,778 | A | * | 6/2000 | Lindberg | 297/229 X |
| 6,131,995 | A | * | 10/2000 | Smith | 297/224 X |

FOREIGN PATENT DOCUMENTS

| | | | | |
|---|---|---|---|---|
| FR | 2399223 | * | 4/1979 | 297/229 |
| GB | 1004647 | * | 9/1965 | 297/229 |
| GB | 1316564 | * | 5/1973 | 297/228.11 |

* cited by examiner

*Primary Examiner*—Jose V. Chen
*Assistant Examiner*—Rodney B. White
(74) *Attorney, Agent, or Firm*—William H. Bollman

(57) ABSTRACT

A chair and cover combination includes a cover and a chair having a leg structure, a seat, and a seat back. The cover includes a singular piece of material having an open end to be placed over the chair. The material covers the seat back, the seat, and the leg structure of the chair in such a manner so as to substantially encapsulate the entire structure of the chair. The cover also includes closing structure generally at the open end which closes the open end.

24 Claims, 3 Drawing Sheets

CHAIR COCOON

This application is based on U.S. Provisional Application No. 60/114,937, filed Jan, 6, 1999, and claims the benefit thereof for priority purposes.

FIELD OF THE INVENTION

The present invention relates to a chair cover and more particularly to a chair and cover combination in which the chair is substantially encapsulated by the cover.

BACKGROUND OF THE INVENTION

It is common to cover a chair with a slipcover to protect the chair from dust, dirt, spills and the like. Most slipcovers are used to cover only the seat and generally wide or large legs of a chair. It is difficult to use a slipcover to cover a conventional, folding metal or wood chair since these types of chairs generally have legs of small diameter of cross-section providing reduced surface area for a slipcover to be attached to and/or in contact with the chair. Furthermore, conventional slipcovers do not substantially cover the entire chair, particularly all surfaces of the legs and the underside of the seat to protect the chair from dirt, dust, etc.

Accordingly, there is a need to provide a cover for a chair which encapsulates or provides a "cocoon" for substantially the entire chair structure.

SUMMARY OF THE INVENTION

An object of the invention is to fulfill the need referred to above. In accordance with the principles of the present invention, this objective is obtained by providing a cover and a chair having a leg structure, a seat, and a seat back. The cover includes a singular piece of material having an open end sized to be placed over the chair. The material covers the seat back, the seat, and the leg structure of the chair in such a manner so as to substantially encapsulate the entire structure of the chair. The cover also includes closing structure disposed generally at the open end which closes the open end.

In accordance with another aspect of the invention, a method of covering a chair is provided. The chair includes leg structure, a seat and a seat back. The cover is a singular piece of material in the form of a pouch having and open end. The method includes placing the open end of the cover over the seat back, the seat and the leg structure of the chair. The open end of the cover is then moved around floor engaging surfaces of the leg structure so that the open end is generally adjacent to an underside of the seat. The open end is then closed in such a manner that the cover substantially encapsulates the entire structure of the chair and such that the cover may be removed from the chair upon reopening the open end.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE ILLUSTRATIVE EMBODIMENTS

Figure 1:
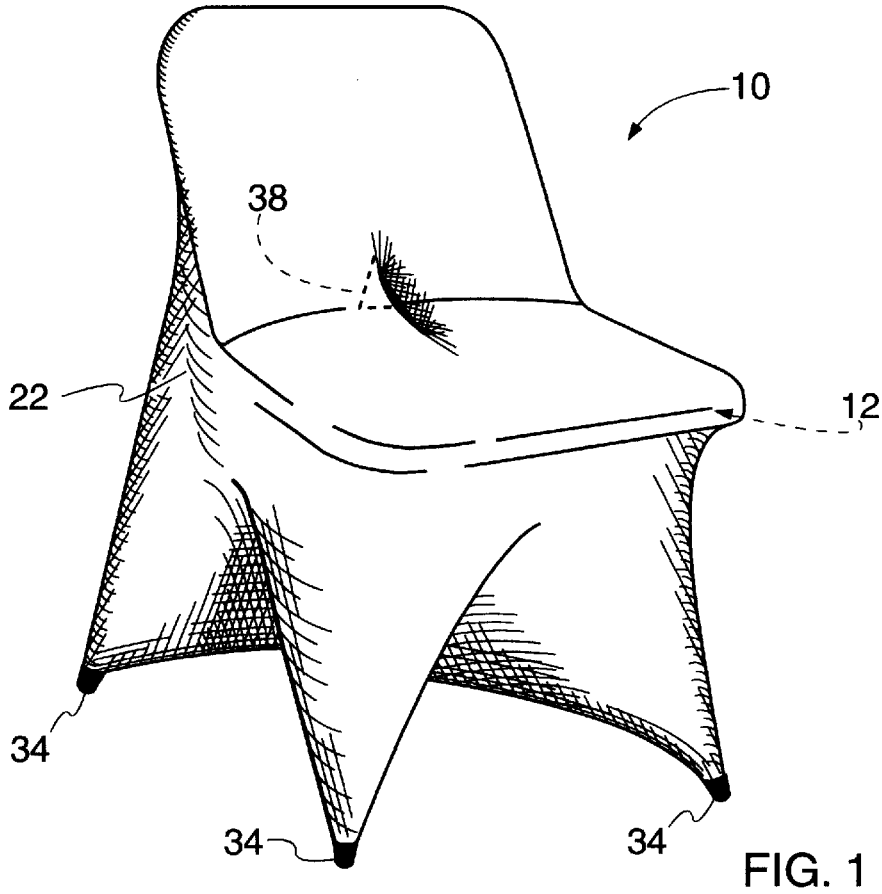
FIG. 1 is a perspective view of a chair and cover combination provided in accordance with the principles of the present invention.

With reference to FIG. 1, a combination chair and chair cover is shown, generally indicated at 10, provided in accordance with the principles of the present invention.

The combination 10 includes a chair, generally indicated at 12, having legs 14, a seat 16 supported by the legs 14, and a seat back 18. In the illustrated embodiment, the chair 12 is a conventional folding chair having a pair of front legs 14' and a pair of rear legs 14" spaced from the front legs 14' when disposed in an operative position. Further, the chair 12 may include a crossbar 19 joining the two front legs 14' and a second cross bar 20 joining the two rear legs 14". The crossbars 19 and 20 are optional and thus need not be provided on a chair of the combination 10. It is within the contemplation of the invention to provide any type of chair having legs, a seat, and a seat back, such as a banquet chair (non-folding type). The particular folding chair shown and described herein is for illustrative purposes only.

The combination 10 also includes a cover 22 (FIG. 1) preferably composed of a singular piece of stretchable material such as, for example, a single piece of nylon, lycra, spandex, polyester, rayon, acetate or tencel material. However, the cover 22 may be composed of two or more pieces of material which may or may not be stretchable. If a one-piece cover 22 is provided, prints or patterns may be disposed on the outer portion thereof. If the cover 22 comprises two or more pieces of material, prints or patterns may be provided thereon or certain pieces thereof may have different colors or have different textures.

Figure 3:
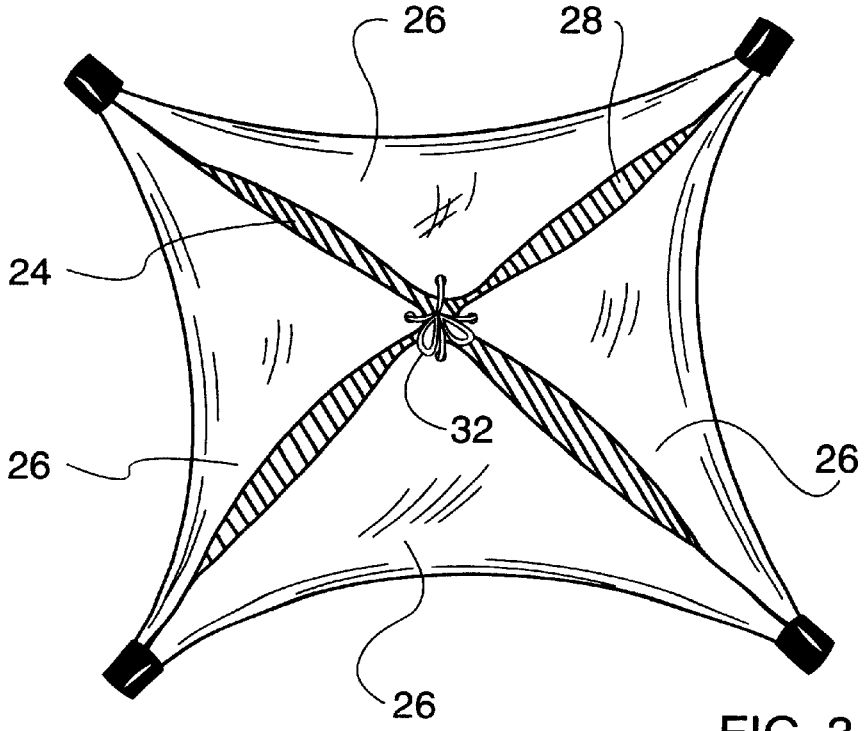
FIG. 3 is a bottom view of the chair-cover combination of FIG. 1 showing the closing structure thereof.

As can be appreciated from FIGS. 1 and 3, the cover 22 is in the form of a pouch and has an open end 24 therein to gain access to the interior of the pouch. The open end 24 is sized to be placed over the chair 12. The cover 22 is constructed and arranged cover the seat back 18, the seat 16 and the legs 14 of the chair 12 so as to substantially encapsulated entire structure of the chair 12, as explained more fully below. Thus, in covering the chair 12, the open end 24 is placed over the seat back 18 and the seat 16 and is pulled downwardly towards the legs 14 of the chair 12. Next, the cover 22 is pulled tight over all of the legs 14 of the chair 12 such that flaps 26 of the cover 22 which define the open end 24 are disposed generally adjacent to the underside 28 of the seat 16. In the illustrated embodiment, since there are four legs, four flaps 26 are created. Finally, closing structure, provided on the cover 22 near flaps 26 or near the open end 24, is used to close the open end 24 at the underside 28 of the seat 16 such that the cover 22 substantially encapsulates the entire structure of the chair 12.

Figure 4:
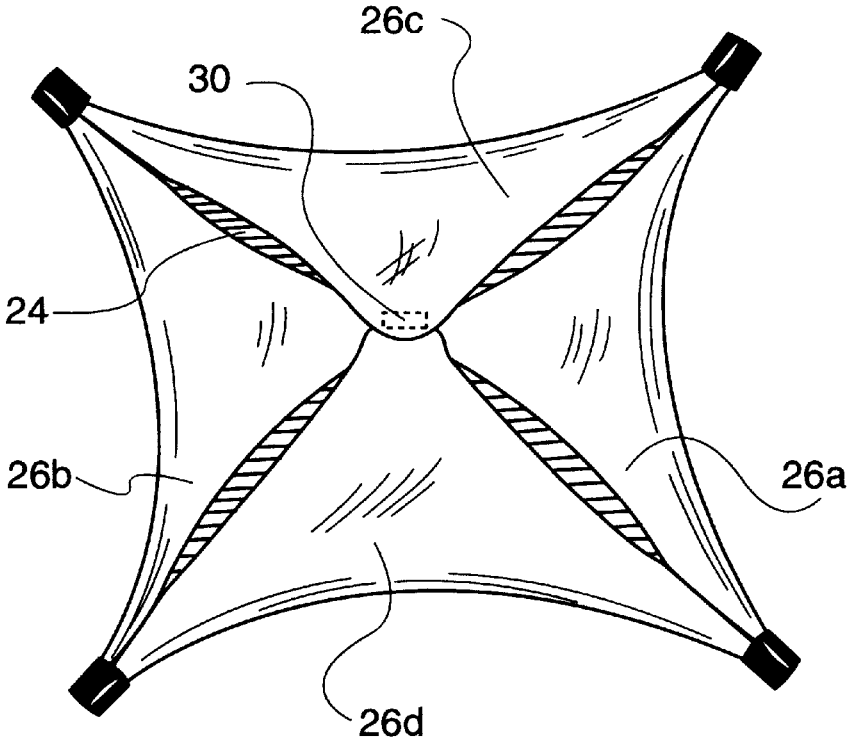
FIG. 4 is a bottom view of the chair-cover combination of FIG. 1 showing a second embodiment of closing structure thereof.

In the embodiment of FIG. 4 the closing structure comprises hook and loop structure 30 such as Velcro® provided on the cover at certain locations around the open end 24. For example, when four flaps are created, opposing flaps 26*a*, 26*b*, and 26*c* and 26*d*, may be secured together using cooperating hook and loop structure 30 associated therewith.

Figure 5:
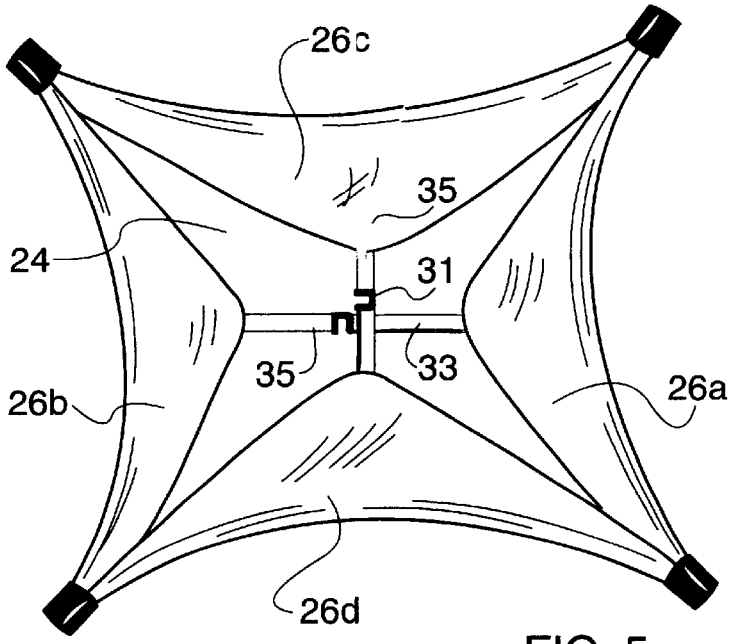
FIG. 5 is a bottom view of the chair-cover combination of FIG. 1 showing a third embodiment of closing structure thereof.
Figure 6:
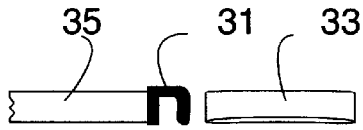
FIG. 6 is an enlarged view of the closings structure of FIG. 5.

With reference to FIGS. 5 and 6, another embodiment of the closing structure comprises a hook member 31 coupled to flaps 26*a* and 26*c* and loops 33 coupled to the opposing flaps 26*d* and 26*b*. Each hook member 31 is attached to elastic material 35 and each loop 33 is made of elastic material. Thus, a hook member 31 is joined to a cooperating loop 33 to close the open end 24.

With reference to FIG. 3, instead of providing hook and loop structure of FIG. 4 and 5, the closing structure comprises a plurality of strings or ties 32 provided on the cover generally adjacent to the open end 24. The ties 32 may be tied together in such a manner to close the open end 24 at the underside 28 of the seat 16. For example, each flap 26 may include a tie 32 which may be tied to another tie on a different flap 26, or some of the ties 32 may be in the form of loops which receive other ties 32.

Instead of providing ties or hook and loop structure, the closing structure may include buttons, snaps, zippers, or any other structure suitable to close the open end 24.

Figure 2:
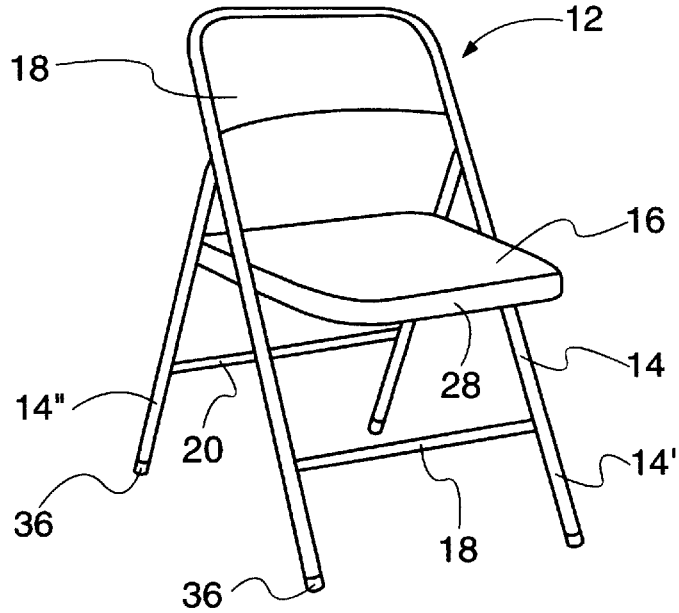
FIG. 2 is a perspective view of a chair of the chair-cover combination of FIG. 1.
Figure 7:
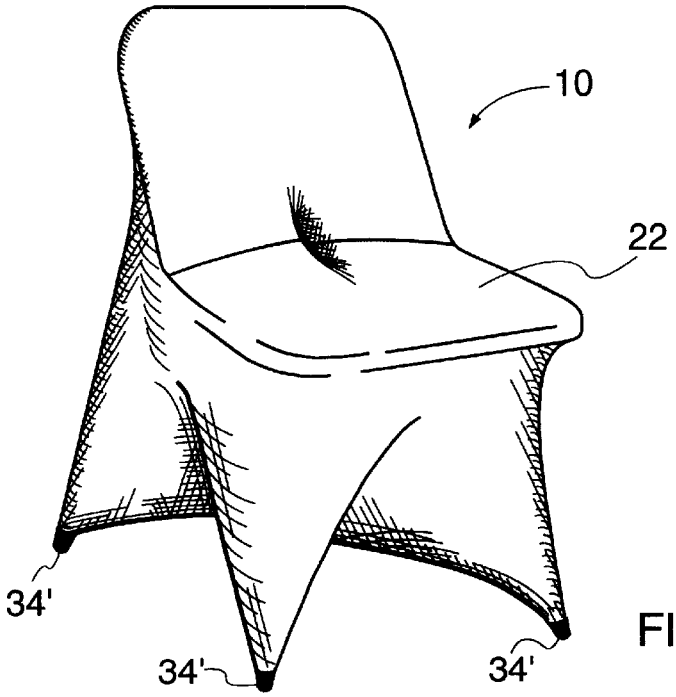
FIG. 7 is a perspective view of a chair of the chair-cover combination employing patch structure to protect the floor engaging points of the cover, provided in accordance with the invention.

As best shown in FIG. 1, a flexible cap 34, preferably molded from plastic or rubber, is placed over the material of the cover 22 which covers the floor engaging end 36 (FIG. 2) of each leg 14 of the chair 12 to protect the cover 22 from wear, since if the caps 34 were not provided, portions of the cover 22 would contact the floor directly. Alternatively, with reference to FIG. 7, small patches of material 34' may be sewn onto the outside surface of the cover which covers the floor engaging ends of the chair to provide reinforcement and protection of the cover. The material 34' is preferably vinyl, leather, or any other sturdy material.

With reference to FIG. 1, optionally, the front and back portions of the cover 22, near the juncture of the seat 16 and seat back 18, are secured together. This can be accomplished by providing joining structure preferably within an interior proton of the cover 22. In the embodiment of FIG. 1, the joining structure comprises cooperating hook and loop structure 38 disposed on the underside of the front and back portions of the cover 22 near the base of the seat 16. It can be appreciated that other joining structure may be employed such as, for example, buttons, snaps or ties to join the front and back portions of the cover 22 near the base of the seat 16 to create an "upholstered" look and to pull-in the cover 22 at the seat 16 so that the cover material is taut.

Since the cover 22 stretches tight over the entire chair 12, wraps around the legs 14, and is pulled back at the underside 28 of the seat 16, there is no "skirt effect" as is the case with conventional slip covers. The stretched cover material pulls-up at the bottom of the chair 12 creating an "arc effect" or sculptured effect giving the illusion of upholstered shaped legs.

The cover 22 not only gives an otherwise plain chair 12 an improved look, the cover 22 also functions to protect the chair 12 from dust and wear. In addition, if a metal chair 12 is used, the cover 22 provides a more comfortable seating surface than merely exposed metal. Still further, since the cover 22 covers all open areas of the chair 12 (e.g., between the seat 16 and seat back 18), items which may fall out of pockets of a person sitting on the chair-cover combination 10 may remain on the cover 22 and may be more easily detected when the person rises from the chair.

The cover 22 is easily removable for cleaning by manipulating the closing structure to open the open end 24 and pulling the cover 22 off of the chair 12.

While the invention has been described with reference to the exemplary preferred embodiments thereof, those skilled in the art will be able to make various modifications to the described embodiments of the invention without departing form the true spirit and scope of the invention.

What is claimed is:

1. A cover assembly for a chair, the chair having legs, a seat and a seat back, the cover assembly comprising:

a cover comprising a singular piece of material having an open end sized to be placed over a chair, said material being constructed and arranged to cover the seat back, the seat, and the legs of the chair in such a manner so as to substantially encapsulate the entire structure of the chair;

closing structure coupled to said material at said open end to close the open end; and cap members constructed and arranged to be placed over the cover at floor engaging ends of each of the legs of the chair such that the material of the cover may be disposed between each leg end and associated cap member.

2. The cover according to claim 1, wherein said material is a stretchable material.

3. The cover according to claim 2, wherein said stretchable material is one of nylon, lycra, spandex, polyester, rayon, acetate, and tencel.

4. The cover according to claim 1, wherein said closing structure comprises hook and loop structure.

5. The cover according to claim 1, wherein said closing structure comprises a hook member on a flap near said open end and a loop member on an opposing flap near said open end, said hook member being engaged with said loop member to close the open end.

6. The cover according to claim 5, wherein said hook member is attached to elastic material and said loop member is made of elastic material.

7. The cover according to claim 1, wherein said closing structure comprises a plurality of ties.

8. The cover according to claim 1, wherein said cover has an interior portion and further includes joining structure within the interior portion constructed and arranged to join opposing sections of the cover together.

9. A cover for a chair, the chair having legs, a seat and a seat back, the cover comprising:

a singular piece of material having an open end sized to be placed over a chair, said material being constructed and arranged to cover the seat back, the seat, and the legs of the chair in such a manner so as to substantially encapsulate the entire structure of the chair;

closing structure coupled to said material at said open end to close the open end; and patch structure attached to said cover at locations where each leg would engage the floor.

10. A chair and cover combination comprising:

a chair having leg structure including a pair of front legs and a pair of rear legs spaced from said front legs in an operative position thereof, a seat, and a seat back, a cover comprising:

a singular piece of material having an open end sized to be placed over the chair, the material covering the seat back, the seat, and the leg structure of the chair in such a manner so as to substantially encapsulate the entire structure of the chair; and closing structure generally at the open end which closes the open end; and.

a cap member covering a floor engaging end of each of said legs such that said material of said cover is disposed between each floor engaging end and associated cap member.

11. The combination according to claim 10, wherein said closing structure closes the open end generally near an underside of the seat.

12. The combination according to claim 10, wherein said chair is foldable.

13. The combination according to claim 10, wherein said material of said cover is stretchable material.

14. The combination according to claim 13, wherein said stretchable material is one of nylon, lycra, spandex, polyester, rayon, acetate, and tencel.

15. The combination according to claim 10, wherein said closing structure comprises a plurality of ties.

16. The combination according to claim 10, wherein said closing structure comprises hook and loop structure.

17. The combination according to claim 10, wherein said closing structure comprises a hook member on a flap near said open end and a loop member on an opposing flap near said open end, said hook member being engaged with said loop member to close the open end.

18. The combination according to claim 17, wherein said hook member is attached to elastic material and said loop member is made of elastic material.

19. A chair and cover combination comprising:

a chair having leg structure including a pair of front legs and a pair of rear legs spaced from said front legs in an operative position thereof, a seat, and a seat back, a cover comprising:

a singular piece of material having an open end sized to be placed over the chair, the material covering the seat back, the seat, and the leg structure of the chair in such a manner so as to substantially encapsulate the entire structure of the chair; and closing structure generally at the open end which closes the open end; and patch structure attached to said cover at floor engaging ends of each of the legs of the chair to protect the cover.

20. The combination according to claim 10, wherein said cover is in the form of a pouch in a folded, storage position.

21. The combination according to claim 20, wherein said cover has an interior portion and further includes joining structure within the interior portion constructed and arranged to join opposing sections of the cover together generally near a base of said seat.

22. A method of covering a chair, the chair including leg structure, a seat and a seat back, the cover comprising a singular piece of material in the form of a pouch having and open end, the method including:

placing the open end of the cover over the seat back, the seat and the leg structure of the chair, moving the open end of the cover around and covering floor engaging surfaces of the leg structure so that the open end is generally adjacent to an underside of the seat, and closing the open end in such a manner that the cover substantially encapsulates the entire structure of the chair and such that the cover may be removed from the chair upon reopening of the open end, wherein said leg structure includes a pair of front legs and a pair of rear legs, each of said legs having ends defining the floor engaging surfaces, the method including providing protective material on said cover at an end of each leg such that material of the cover is disposed between the end of each leg and the protective material.

23. The method according to claim 22, wherein the cover includes hook and loop structure near the open end and the step of closing the open end includes securing the hook and loop structure.

24. The method according to claim 22, wherein the cover includes a plurality of ties near the open end and the step of closing the open end includes tying certain of the ties together.

* * * * *